US011518064B2

(12) United States Patent
Krentz et al.

(10) Patent No.: US 11,518,064 B2
(45) Date of Patent: Dec. 6, 2022

(54) CONCRETE PRODUCT MACHINE MOLD ASSEMBLY STRIPPER HEAD PLATE DEFLECTION IMPEDANCE

(71) Applicant: Besser Company, Alpena, MI (US)

(72) Inventors: Douglas Krentz, Alpena, MI (US); Devin Kendziorski, Alpena, MI (US)

(73) Assignee: Besser Company, Alpena, MI (US)

( * ) Notice: Subject to any disclaimer, the term of this patent is extended or adjusted under 35 U.S.C. 154(b) by 673 days.

(21) Appl. No.: 16/407,662

(22) Filed: May 9, 2019

(65) Prior Publication Data

US 2019/0344472 A1 Nov. 14, 2019

Related U.S. Application Data

(60) Provisional application No. 62/668,973, filed on May 9, 2018.

(51) Int. Cl.
*B28B 7/00* (2006.01)

(52) U.S. Cl.
CPC ..... *B28B 7/002* (2013.01)

(58) Field of Classification Search
CPC ..... B28B 7/002; B28B 3/06; B28B 7/0097; F16F 9/535; F16F 15/03; F16F 7/00; F16F 9/537; F16F 1/361; F16B 2001/0035
See application file for complete search history.

(56) References Cited

U.S. PATENT DOCUMENTS 4,249,358 A * 2/1981 Thieffry ..... B28B 3/06 264/297.9
4,679,775 A * 7/1987 Funaki ..... F16F 6/00 188/267.2
5,395,228 A * 3/1995 Aeseth ..... B28B 3/022 425/452
6,305,656 B1 * 10/2001 Wemyss ..... B60R 11/0241 220/628
10,484,786 B1 * 11/2019 Hsu Huang ..... H04R 1/2811
10,923,261 B2 * 2/2021 Singla ..... H01F 7/02
2006/0182840 A1 * 8/2006 High ..... B28B 15/005 425/432
2014/0000068 A1 * 1/2014 Casini ..... A44C 5/2071 24/303
2014/0220172 A1 * 8/2014 Krentz ..... B28B 1/0873 425/456
2016/0032954 A1 * 2/2016 Porter ..... H01F 7/0205 24/303

OTHER PUBLICATIONS

Besser drawing disclosing a known concrete product machine mold assembly arrangement manufactured and sold by the applicant, Besser.

* cited by examiner

*Primary Examiner* — Leith S Shafi
(74) *Attorney, Agent, or Firm* — Mechanicus PLLC

(57) ABSTRACT

A deflection impedance device is provided for a stripper head plate of a concrete product machine mold assembly. The device may comprise a spacer having an axial thickness generally equal to a desired spacing between an upper surface of a stripper head plate of a mold assembly stripper head, and a lower surface of a mold head adapter plate of a concrete product machine. A magnetic element may be used to retain the spacer on the stripper head plate upper surface where it will brace the stripper head plate against the mold head adapter plate to limit or prevent upward bowing that might otherwise result from forces imparted by concrete product being formed within the mold assembly.

12 Claims, 5 Drawing Sheets

CONCRETE PRODUCT MACHINE MOLD ASSEMBLY STRIPPER HEAD PLATE DEFLECTION IMPEDANCE

CROSS-REFERENCES TO RELATED APPLICATIONS

This application claims the benefit of the filing date of U.S. Provisional Patent Application Ser. No. 62/668,973 filed May 9, 2018.

STATEMENT REGARDING FEDERALLY SPONSORED RESEARCH OR DEVELOPMENT

Not Applicable

BACKGROUND

Field

This application relates generally to a device for impeding deflection of a stripper head plate of a concrete product machine mold assembly.

Description of Related Art Including Information Disclosed Under 37 Cfr 1.97 and 1.98

Concrete product making machines are known to include mold assemblies that include stripper head plates. When such a mold assembly is in use in a concrete product making machine, upward forces that are applied by a concrete product being formed within the mold assembly can cause the stripper head plate to bow upward. When a stripper head plate bows upward in this manner, it can impart a corresponding upward or outward bow in surfaces of concrete products, where uniformly flat surfaces are generally desired in such products to accommodate the stacking of products, such as concrete blocks, upon one another in construction applications.

SUMMARY

A concrete product machine mold assembly stripper head plate deflection impedance device is provided for impeding deflection of a stripper head plate of a concrete product machine mold assembly. The device may comprise a spacer having an axial thickness generally equal to a desired spacing between an upper surface of a stripper head plate of a mold assembly stripper head, and a lower surface of a mold head adapter plate of a concrete product machine. A magnetic element may be carried by the spacer and configured and positioned to retain the spacer on the upper surface of the stripper head plate in a position where the spacer will brace the stripper head plate against the mold head adapter plate, and where the stripper head plate might otherwise experience undesirable upward deflection in response to forces applied by a concrete product being formed within the mold assembly.

Also, a method is provided for impeding deflection of a stripper head plate of a concrete product machine mold head assembly by determining, in a stripper head plate of a concrete product machine mold assembly, a location where the stripper head plate will experience an undesirable degree of upward deflection when a concrete product is being formed within the mold assembly; and then supporting, on an upper surface of the stripper head plate, in that location, a spacer having a magnetic element and having an axial thickness generally equal to a desired spacing between the upper surface of the stripper head plate and a lower surface of a mold head adapter plate of the concrete product machine. A concrete product is then formed within the mold assembly.

DRAWING DESCRIPTIONS

These and other features and advantages will become apparent to those skilled in the art in connection with the following detailed description and drawings of one or more embodiments of the invention, in which.

DETAILED DESCRIPTION

Figure 1:
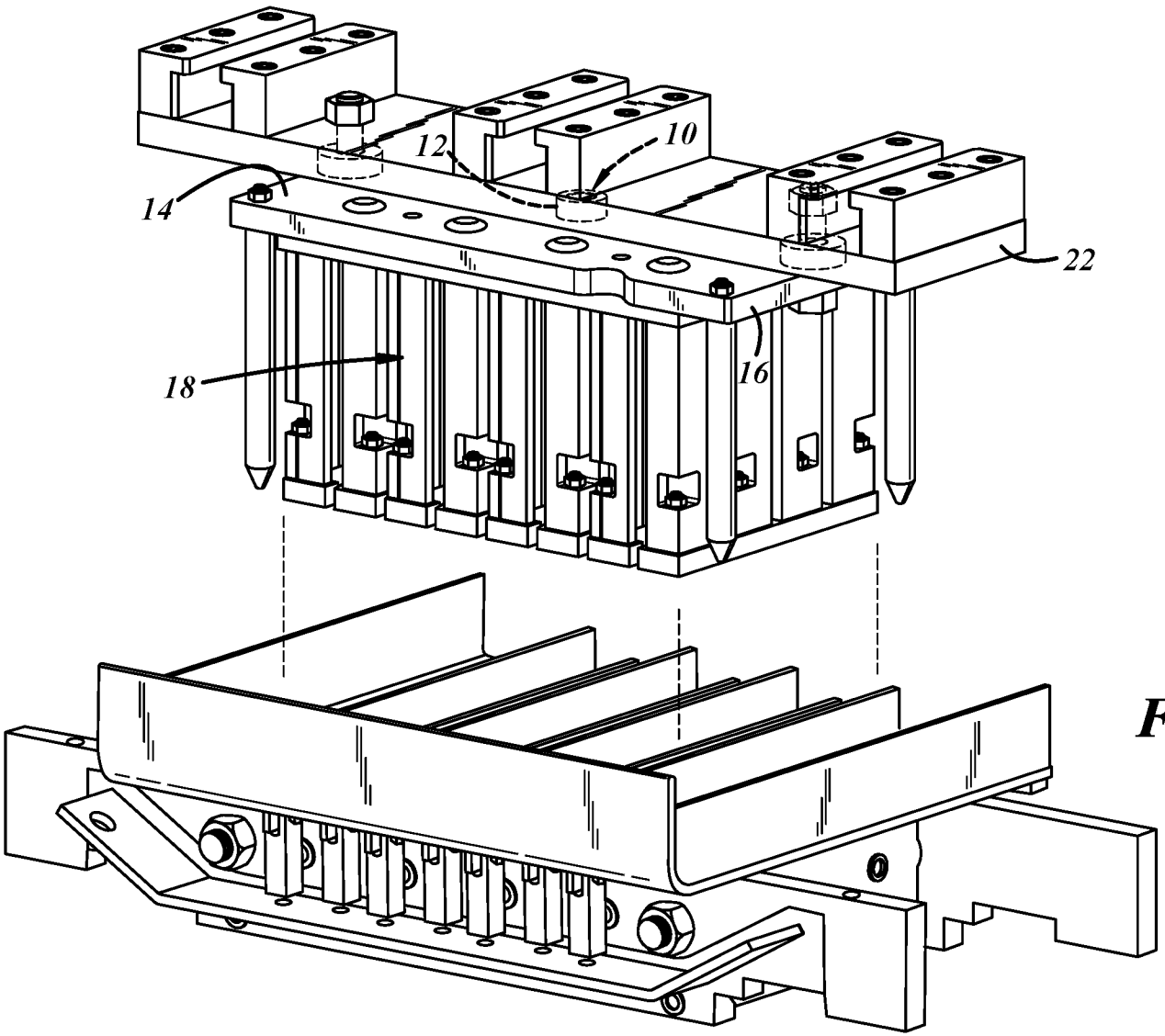
FIG. 1 is an orthogonal view of concrete product machine mold head assembly shown in a position removed from and spaced above a mold box of a concrete product machine, and with a stripper head plate deflection impedance device shown hidden between a stripper head plate and a mold head adapter plate of the mold head assembly.
Figure 2:
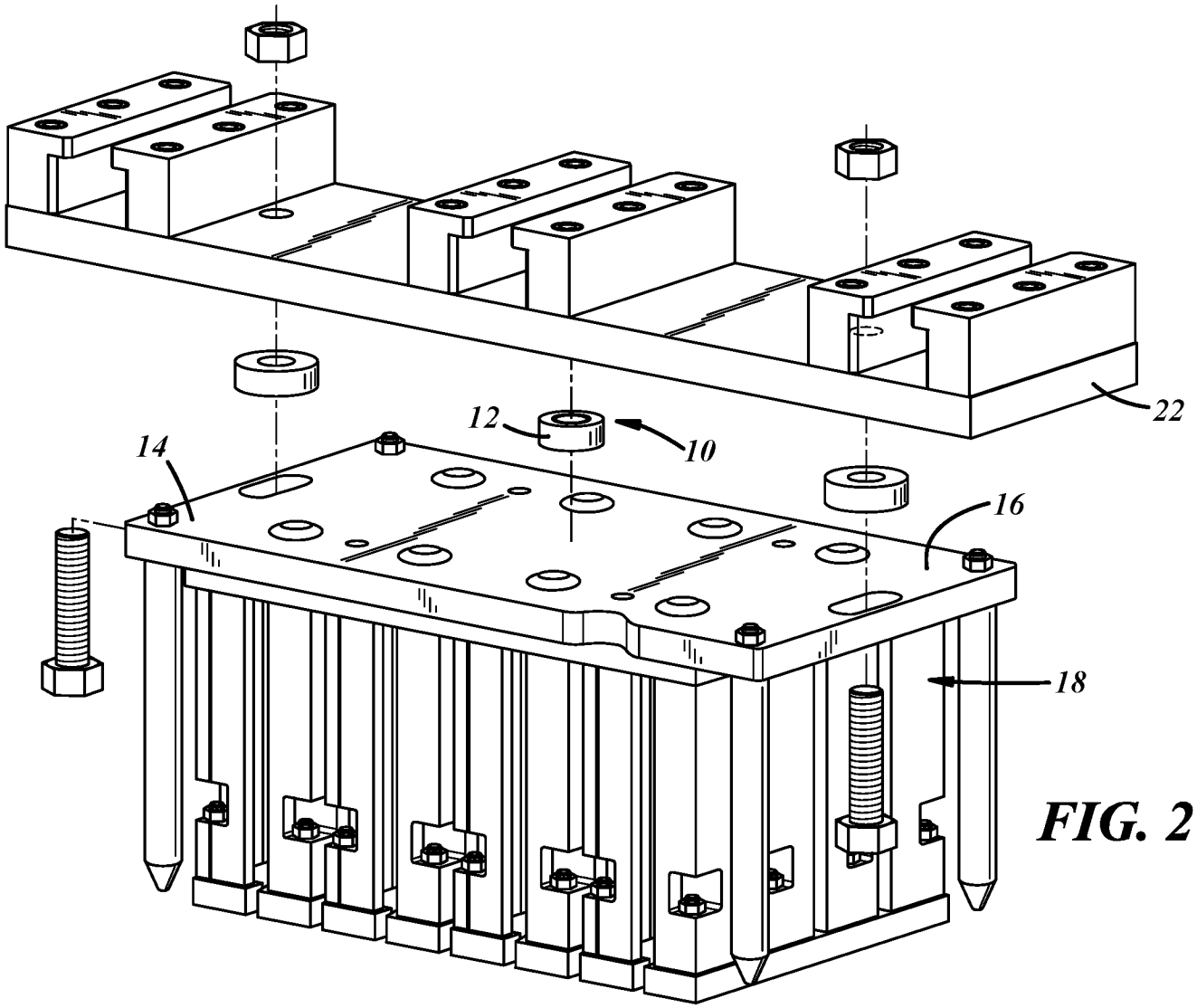
FIG. 2 is an orthogonal exploded view of the concrete product machine mold head assembly of FIG. 1, with the mold head adapter plate shown spaced above the stripper head plate, and with the stripper head plate deflection impedance device shown spaced between them.
Figure 3:
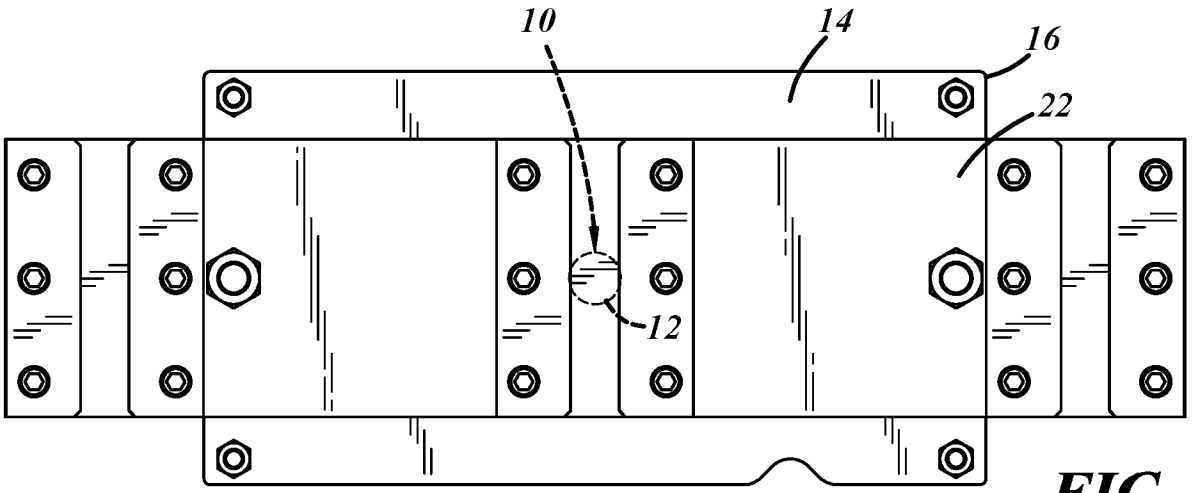
FIG. 3 is a top view of the mold head adapter plate and stripper head plate of FIG. 1 with the stripper head plate deflection impedance device shown hidden between them.
Figure 4:
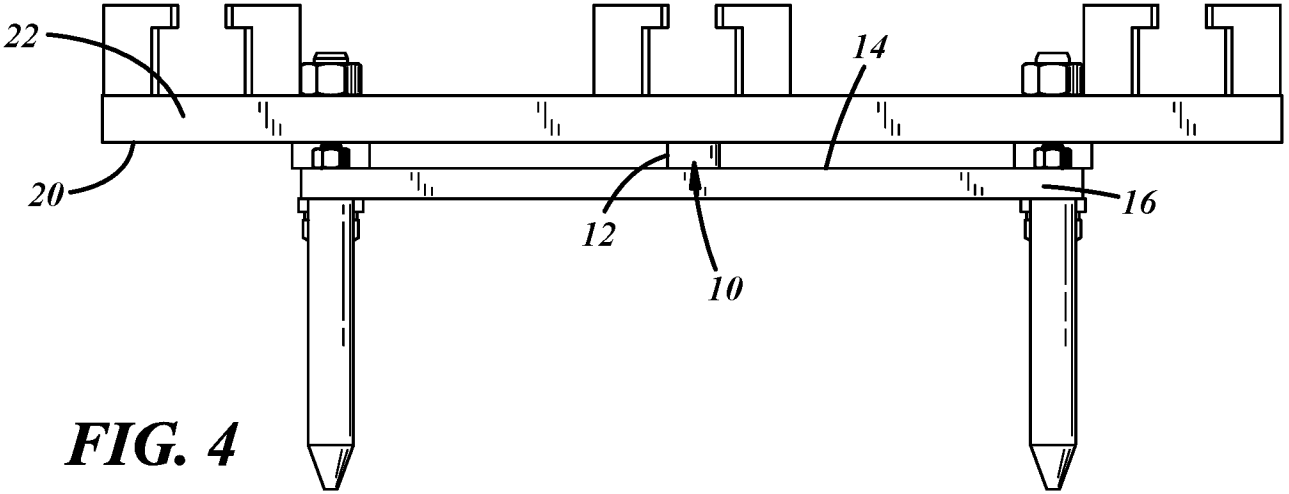
FIG. 4 is a side view of the mold head adapter plate, stripper head plate, and stripper plate deflection impedance device of FIG. 3.
Figure 5:
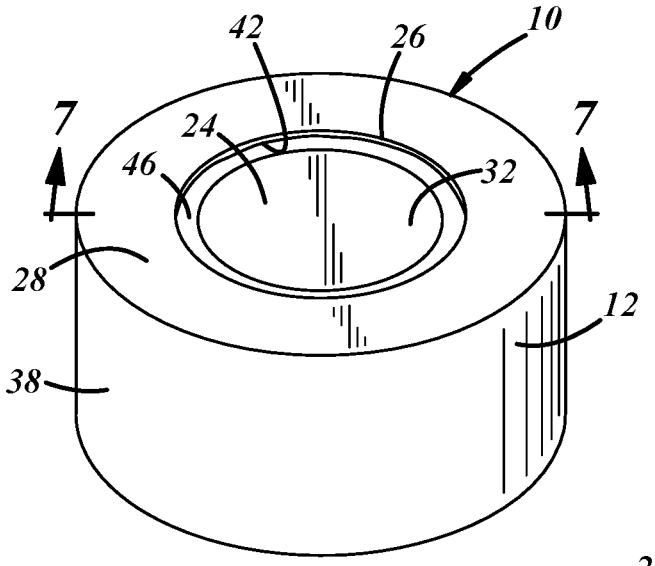
FIG. 5 is an orthogonal view of the stripper head plate deflection impedance device of FIGS. 1-4.
Figure 6:
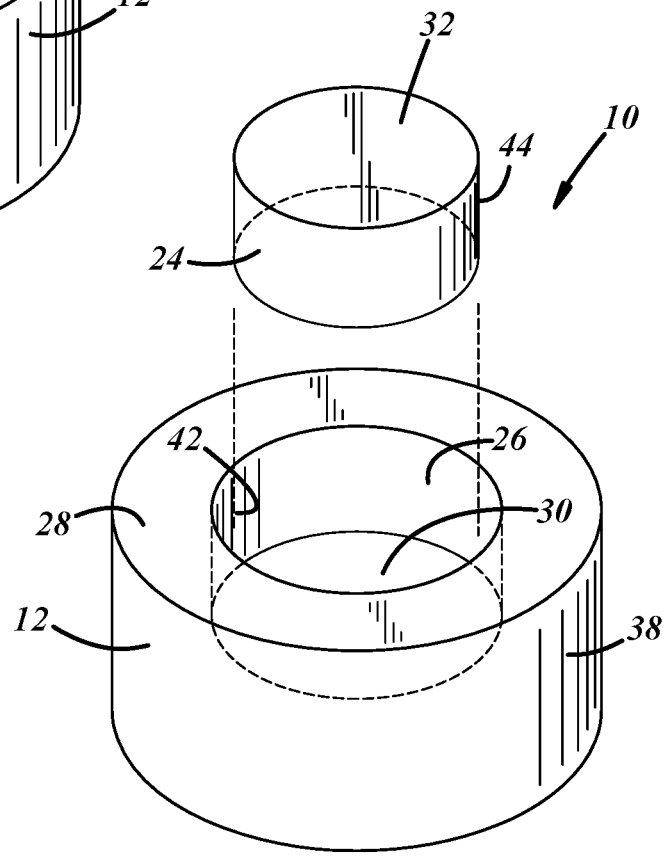
FIG. 6 is an orthogonal exploded view of the stripper head plate deflection impedance device of FIG. 5, with a magnetic element of the device shown spaced above a magnet receptacle formed in a spacer portion of the device.
Figure 7:
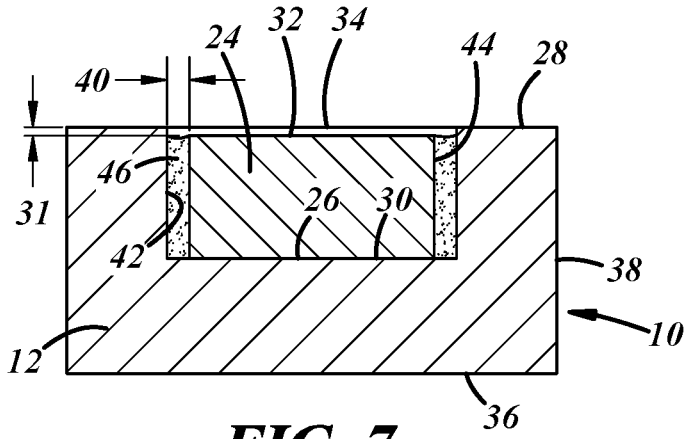
FIG. 7 is a cross-sectional side view of the stripper head plate deflection impedance device of FIG. 5, taken along line 7-7 of FIG. 5.

A device that impedes deflection of a stripper head plate of a concrete product machine mold head assembly is generally indicated at 10 in FIGS. 1 and 2. As best shown in FIGS. 4-7, the device 10 may include a spacer 12 having an axial thickness generally equal to a desired spacing between an upper surface 14 of a stripper head plate 16 of a mold assembly stripper head 18, and a lower surface 20 of a mold head adapter plate 22 of a concrete product machine. As shown in FIGS. 5-7, the device 10 may also include a magnetic element 24 that may be carried by the spacer 12 and configured and positioned to retain the spacer 12 on the stripper head plate upper surface 14 in a position where the spacer 12 will brace the stripper head plate 16 against the mold head adapter plate 22, and where the stripper head plate 16 might otherwise experience undesirable upward deflection in response to forces applied by a concrete product being formed within the mold assembly—and where an upper surface of the spacer 12 will engage an unobstructed portion of a lower surface 20 of the mold head adapter plate 22.

The spacer 12 may comprise ferrous metal, and, as shown in FIGS. 5-7, the magnetic element 24 may be received in a magnet receptacle 26 formed in the spacer 12. The magnet receptacle 26 may be formed downward into the spacer 12 from an upper surface 28 of the spacer 12, and the magnetic element 24 may be retained on a floor 30 of the magnet receptacle 26 by magnetic force generated by the magnetic element 24.

As best shown in FIG. 7, the magnetic element 24 may have an axial thickness less than an axial depth of the magnet receptacle 26, to leave a gap 31 between an upper surface 32 of the magnetic element 24 and a plane 34 defined by the spacer upper surface 28. This is so that the magnetic force securing the magnetic element 24 to the floor 30 of the magnet receptacle 26 will be greater than the magnetic force holding the spacer 12 to the stripper head plate 16 and will thus resist separation of the magnetic element 24 from the spacer 12 when the spacer 12 is engaged against a lower surface 20 of a mold head adapter plate 22. In a preferred embodiment the magnetic element 24 may comprise a permanent magnet, and the axial thickness of the magnetic element 24 may be 0.03 inches less than the axial depth of the magnet receptacle 26.

As best shown in FIGS. 5-7, the spacer 12 may be generally puck-shaped and may have a circular bottom surface 36 and a cylindrical outer side wall 38. The magnet receptacle 26 may be generally cylindrical and may be formed coaxially downward into the spacer 12 from the spacer upper surface 28. The magnetic element 24 may also be generally puck shaped and may be retained in a coaxial position on the floor 30 of the magnet receptacle 26 by the magnetic force generated by the magnetic element 24. And, in a preferred embodiment, the magnetic element 24 may have a 1.000-inch diameter, a 0.500-inch axial thickness, and may be configured to exert a 35 lb. magnetic holding force.

As best shown in FIGS. 5 and 7, the magnetic element 24 may have a diameter less than an inner diameter of the magnet receptacle 26 and may be positioned coaxially within the magnet receptacle 26 such that a circumferential gap 40 may be defined between an inner side wall 42 of the magnet receptacle 26 and an outer side wall 44 of the magnetic element 24. This arrangement is intended to reduce lateral shock transmission through the magnetic receptacle inner side wall 42 to the magnetic element 24 should, for example, the spacer 12 be dropped. In a preferred embodiment the diameter of the magnetic element 24 may be 0.19 inches less than the inner diameter of the magnet receptacle 26.

As shown in FIGS. 5 and 7, a resilient substance 46 may be disposed within and may fill the circumferential gap 40. This is to help retain the magnetic element 24 within the magnet receptacle 26 of the spacer 12 and to protect the magnetic element 24 from shocks applied to the spacer 12. In a preferred embodiment, the resilient substance 46 may comprise silicone.

Figure 8:
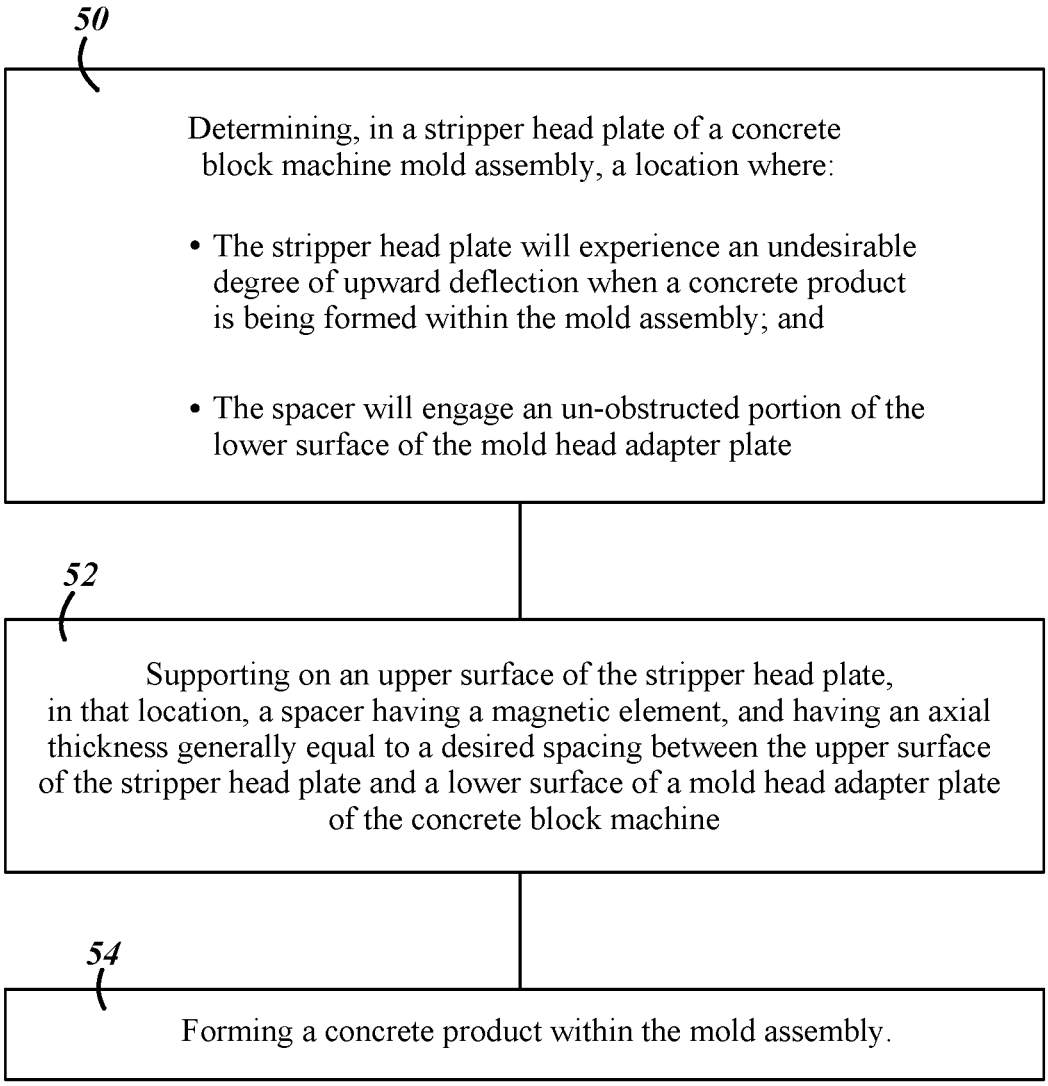
FIG. 8 is a flow chart showing a method for impeding deflection of a stripper head plate of a concrete product machine mold assembly.

In practice, and as shown at action step 50 in the method flow chart of FIG. 8, in advance of performing a concrete molding operation, upward deflection of a stripper head plate 16 of a concrete product machine mold assembly can be impeded by first determining, on a stripper head plate 16 of the concrete product machine mold assembly, a location where the stripper head plate 16 will experience an undesirable degree of upward deflection when a concrete product is being formed within the mold assembly. As shown in action step 52, such a location may also be determined such that, in addition, the spacer 12 will engage an un-obstructed portion of the mold head adapter plate lower surface 20. As shown in action step 54, a ferrous metal spacer 12 may then be supported in that location, on a stripper head plate upper surface 14. As disclosed above, the ferrous metal spacer 12 may have a magnetic element 24 that provides the holding force required to retain the spacer 12 on the stripper head plate upper surface 14 and may have an axial thickness generally equal to a desired spacing between the stripper head plate upper surface 14 and a lower surface 20 of a mold head adapter plate 22 of the concrete product machine.

This description, rather than describing limitations of an invention, only illustrates (an) embodiment(s) of the invention recited in the claims. The language of this description is therefore exclusively descriptive and is non-limiting.

Obviously, it's possible to modify this invention from what the description teaches. Within the scope of the claims, one may practice the invention other than as described above.

What is claimed is:

1. A concrete product machine mold assembly comprising:
- a stripper head plate;
- a mold head adapter plate carried by the stripper head plate; and
- a stripper head plate deflection impedance device comprising:
  - a spacer having an axial thickness generally equal to a desired spacing between an upper surface of the stripper head plate, and the lower surface of a mold head adapter plate; and
  - a magnetic element carried by the spacer and configured and positioned to retain the spacer on the upper surface of the stripper head plate in a position where the spacer will brace the stripper head plate against the mold head adapter plate, and where the spacer will brace the stripper head plate against undesirable upward deflection in response to forces applied by a concrete product being formed within the mold assembly.

2. A concrete product machine mold assembly as defined in claim 1 in which the magnetic element is received in a magnet receptacle formed in the spacer.

3. A concrete product machine mold assembly as defined in claim 2 in which:
- the spacer comprises ferrous metal;
- the magnet receptacle is formed downward into the spacer from an upper surface of the space; and
- the magnetic element is retained on a floor of the magnet receptacle by magnetic force generated by the magnetic element.

4. A concrete product machine mold assembly as defined in claim 3 in which the magnetic element has a thickness less that a depth of the magnet receptacle.

5. A concrete product machine mold assembly as defined in claim 4 in which the spacer is generally puck-shaped and has a circular bottom surface and a cylindrical outer side wall.

6. A concrete product machine mold assembly as defined in claim 5 in which the magnet receptacle is generally cylindrical and is formed coaxially downward into the spacer from the upper surface of the spacer.

7. A concrete product machine mold assembly as defined in claim 6 in which the magnetic element is generally puck shaped and is retained on a floor of the magnet receptacle by the magnetic force generated by the magnetic element.

8. A concrete product machine mold assembly as defined in claim 7 in which the magnetic element has a diameter less than an inner diameter of the magnet receptacle and is positioned within the magnet receptacle such that a circumferential gap is defined between an inner side wall of the magnet receptacle and an outer side wall of the magnetic element.

9. A concrete product machine mold assembly as defined in claim 8 in which a resilient substance is disposed within the circumferential gap.

10. A concrete product machine mold assembly comprising:

a mold assembly stripper head plate;

a mold head adapter plate; and a stripper head plate deflection impedance device comprising:

a spacer having an axial thickness generally equal to a desired spacing between upper surface of the stripper head plate, and the lower surface of a mold head adapter plate of a concrete product machine; and a magnetic element carried by the space and retaining the spacer on the upper surface of the stripper head plate in a position where the spacer will brace the stripper head plate against the mold head adapter plate, and where the spacer will brace the stripper head plate against undesirable upward deflection in response to forces applied by a concrete product being formed within the mold assembly.

11. A concrete product machine mold assembly comprising:

a mold assembly stripper head plate;

a mold head adapter plate; and a stripper head plate deflection impedance device comprising:

a spacer having an axial thickness generally equal to a desired spacing between an upper surface of the stripper head plate, and a lower surface of the mold head adapter plate; and a magnetic element carried by the spacer and retaining the spacer on the upper surface of the stripper head plate;

the spacer being positioned between the stripper head plate and the mold head adapter plate, the mold head adapter plate bracing the stripper head plate, via the spacer, against undesirable upward deflection in response to forces applied by a concrete product being formed within the mold assembly.

12. A concrete product machine mold assembly as defined in claim 11, in which the magnetic element and spacer are configured and position such that magnetic force prevents separation of the magnetic element from the spacer when the spacer is engaged against a lower surface of the mold head adapter plate.

* * * * *